US005766104A

United States Patent [19]

Albarelli, Jr.

[11] Patent Number: 5,766,104

[45] Date of Patent: Jun. 16, 1998

[54] TOY STRIKING IMPLEMENTS

[75] Inventor: Michael P. Albarelli, Jr., Chester Township, N.J.

[73] Assignee: Amloid Corporation, Saddle Brook, N.J.

[21] Appl. No.: 881,295

[22] Filed: Jun. 24, 1997

[51] Int. Cl.[6] ..... A63B 59/06

[52] U.S. Cl. ..... 473/567

[58] Field of Search ..... 473/516, 558, 473/559, 564–568, 168–170

[56] References Cited

U.S. PATENT DOCUMENTS 4,006,908 2/1977 Minami .
4,053,156 10/1977 Bai .
4,079,935 3/1978 Gormley .
4,374,590 2/1983 Everlith et al. .
4,541,629 9/1985 Witkowski .
4,874,570 10/1989 Haines .
5,150,897 9/1992 Wortman .
5,301,940 4/1994 Seki et al. .
5,306,001 4/1994 Shishido et al. .
5,480,143 1/1996 McMurry .

*Primary Examiner*—Mark S. Graham
*Attorney, Agent, or Firm*—Arthur Jacob

[57] ABSTRACT

A toy striking implement in the form of a baseball bat especially well-suited to manufacture by injection molding includes a striking portion having longitudinally spaced apart semi-annular ribs supported and reinforced by a central web in the form of a solid blade-like wall and external stringers spaced laterally from the web, and a gripping portion molded unitary with the striking portion for gripping and swinging the striking implement.

20 Claims, 5 Drawing Sheets

TOY STRIKING IMPLEMENTS

The present invention relates generally to toys and games and pertains, more specifically, to the construction of toy striking implements, such as bats, clubs, sticks and the like, which are grasped by a child and are swung to strike a ball or another playing piece.

Toy striking implements have been a mainstay in the realm of toys and games and, over the years, have been offered in many different forms and structures. For example, toy baseball bats have been manufactured of metal, wood and synthetic polymeric materials in a myriad of shapes and sizes. Among the more popular toy baseball bats are those manufactured by blow molding a synthetic polymeric material to form a hollow striking implement in the shape of a baseball bat. However, blow molding is a more expensive molding technique as compared to other available molding methods, such as injection molding, and is limited to the use of only certain materials, such as blow-moldable polyethylene, while more desirable materials, such as high-density polyethylene, used in injection molding processes, are not amenable to blow molded manufacture.

The present invention enables toy striking implements, such as those previously made by blow molding, to be manufactured by injection molding to yield toy striking implements constructed of materials heretofore not practical for such implements. As such, the present invention attains several objects and advantages, some of which are summarized as follows: Enables the manufacture of toy striking implements, such as toy baseball bats, using injection molding techniques and materials heretofore not available for such toys; provides toy striking implements, such as bats, clubs, sticks and the like, of increased strength and reliability; produces toy striking implements which exhibit an effective combination of unique and highly distinctive form as well as an aesthetically attractive appearance; attains a desired resilience coupled with reinforced strength in toy striking implements of economical construction; allows economical manufacture of toy striking implements of better controlled dimensions in larger quantities of consistently higher quality and in a wider variety of desirable shapes, sizes and colors; enables the manufacture of rugged toy striking implements providing exemplary performance over a relatively long service life.

The above objects and advantages, as well as further objects and advantages, are attained by the present invention which may be described briefly as a toy striking implement particularly well-suited for manufacture by injection molding of a synthetic polymeric material, the implement comprising: an elongate body extending longitudinally between opposite first and second ends and including a striking portion and a gripping portion; the striking portion of the body having: a longitudinal length; an outer contour configuration including longitudinal profile components and lateral profile components; a web extending longitudinally between the first end and the second end, the web including laterally opposite edges and opposite faces extending between the laterally opposite edges, each edge following a web-edge profile corresponding to a longitudinal profile component of the outer contour configuration of the striking portion; a plurality of ribs spaced from one another longitudinally along the striking portion to establish spaces between adjacent ribs, the ribs intersecting the web along the edges of the web, each rib being placed at an individual longitudinal location along the web and following a rib profile corresponding to a lateral profile component of the outer contour configuration of the striking portion, the ribs and spaces being grouped in laterally opposite first and second sets of ribs and spaces, the first set of ribs and spaces being staggered longitudinally with respect to the second set of ribs and spaces such that the ribs of the first set are located laterally opposite the spaces of the second set and the ribs of the second set are located laterally opposite the spaces of the first set; and stringers spaced laterally from the opposite faces of the web and joining the ribs of the first set to the ribs of the second set, the stringers extending along stringer profiles corresponding to further longitudinal profile components of the outer contour configuration of the striking portion; and the gripping portion of the body having a hand grip extending between the striking portion and the second end of the body.

The invention will be understood more fully, while still further objects and advantages will become apparent, in the following detailed description of a preferred embodiment of the invention illustrated in the accompanying drawing, in which.

Figure 1:
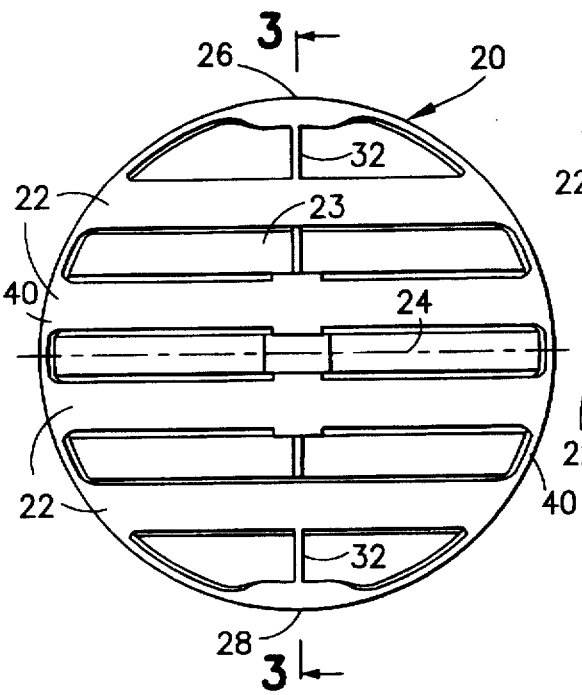
FIG. 1 PRIOR ART
FIG. 1 is an enlarged front elevational view of a toy ball known in the prior art.
Figure 2:
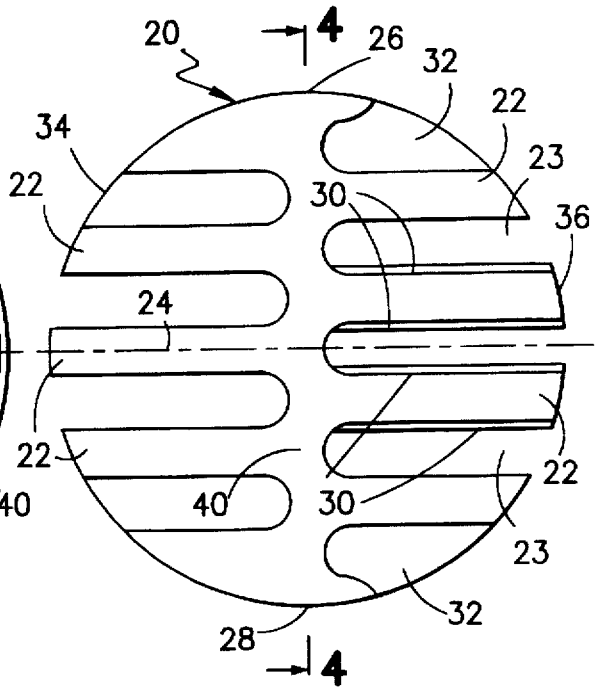
FIG. 2 PRIOR ART
FIG. 2 is a side elevational view of the toy ball.
Figure 3:
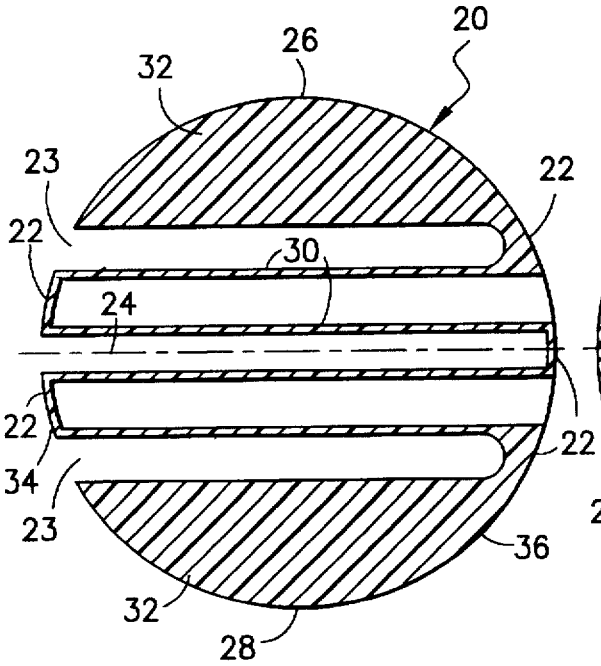
FIG. 3 PRIOR ART
FIG. 3 is a cross-sectional view of the toy ball, taken along line 3—3 of FIG. 1.
Figure 4:
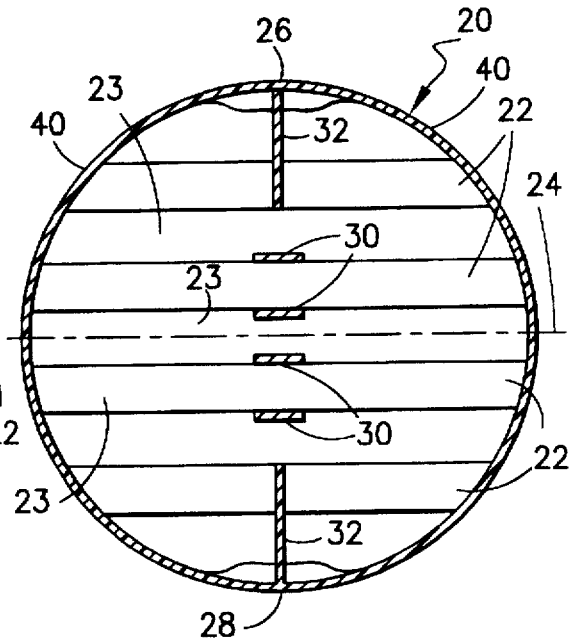
FIG. 4 PRIOR ART
FIG. 4 is a cross-sectional view of the toy ball, taken along line 4—4 of FIG. 2.

Referring now to the drawing, and especially to FIGS. 1 through 4 thereof, a toy ball 20 known in the prior art has a construction which includes a plurality of ribs 22 extending parallel to one another and parallel to an equator 24, and spaced apart by spaces 23, between opposite poles 26 and 28. Some of the ribs 22 which are more closely adjacent the equator 24 are tied together by transverse straps 30 extending in first lateral directions through the interior of the ball 20, while others of the ribs 22 located more closely adjacent the poles 26 and 28 are tied together by fins 32 extending through the interior of the ball 20 in second lateral directions normal to the first lateral directions of the straps 30. The ribs 22 and spaces 23 extend along opposite hemispheres 34 and 36 and the hemispheres 34 and 36 are joined along meridian portions 40 extending between the poles 26 and 28. The ribs 22 of one of the hemispheres 34 and 36 are staggered in directions between the poles 26 and 28 relative to the ribs 22 of the other of the hemispheres 34 and 36 so that each rib 22 of a hemisphere 34 or 36 is opposite a space 23 in the opposite hemisphere 36 or 34, respectively. The construction enables the ball 20 to be manufactured in one piece by injection molding.

Turning now to FIGS. 5 through 12, a toy striking implement constructed in accordance with the present invention is illustrated in the form of a toy baseball bat 50. Bat 50 has an elongate body 52 extending longitudinally along a longitudinal axis A between a first end 54 and an opposite second end 56 and includes a striking portion 60 and a gripping portion 62. The striking portion 60 has a longitudinal length L and an overall outer contour configuration C which includes longitudinal profile components 64 lying in longitudinal planes containing axis A, and lateral profile components 66 lying in lateral planes perpendicular to axis A. The longitudinal profile components 64 follow the longitudinal contour configuration of the striking portion of a typical baseball bat, and the lateral profile components 66 are circular and have radii which vary along the longitudinal direction so that together the longitudinal and lateral profile components 64 and 66 provide the overall outer contour configuration C with a shape which emulates the striking portion of a baseball bat.

A web 70 extends longitudinally along the striking portion 60, from the first end 54 toward the second end 56 of the body 52. Web 70 includes laterally opposite edges 72 and opposite faces 74 extending between the opposite edges 72 along the length of the web 70. Each edge 72 follows a web-edge profile 76, the shape of which web-edge profile 76 follows along a corresponding longitudinal profile component 64 of the striking portion 60. In the preferred construction, web 70 lies in a plane 78 (see FIG. 12) extending longitudinally and laterally and containing axis A so as to be located generally centrally of the striking portion 60, and is a solid and continuous blade-like wall which serves as a relatively rigid reinforcing backbone all along the striking portion 60.

A plurality of ribs 80 are coaxial with axis A and are spaced from one another longitudinally along the striking portion 60, the ribs 80 being spaced apart a distance D to establish spaces 82 between adjacent ribs 80. The ribs 80 have an overall semi-annular configuration, intersect the web 70 along the edges 72 of the web 70 and are unitary with the web 70 where the ribs 80 intersect the web 70. Each rib 80 is placed at an individual longitudinal location along the web 70 and follows a rib profile 86 corresponding to the lateral profile component 66 of the overall outer contour configuration C of the striking portion 60 at that location. To that end, the ribs 80 are generally arcuate in planes perpendicular to axis A and include radii which vary along the length of the striking portion 60 so as to correspond to the overall outer contour configuration C of the striking portion 60. The ribs 80 and spaces 82 are grouped in laterally opposite first and second sets 90 and 92, respectively, of ribs 80 and spaces 82, and the first set 90 of ribs 80 and spaces 82 are staggered longitudinally with respect to the second set 92 of ribs 80 and spaces 82 such that the ribs 80 of the first set 90 are located laterally opposite the spaces 82 of the second set 92, and the ribs 80 of the second set 92 are located laterally opposite the spaces 82 of the first set 90.

Since the bat 50 is to be used primarily by children, it has been found that for safety reasons the distance D between ribs 80 must be such that a child's finger or fingers cannot become caught between adjacent ribs 80. Accordingly, the distance D is made either so small that a finger cannot enter a space 82, or so large that a finger which does enter a space 82 cannot become caught in the space 82. Accordingly, distance D is made either no less than 0.310 inch or no more than 0.250 inch. In the preferred embodiment, distance D is about 0.340 inch.

The striking portion 60 includes stringers 100 spaced laterally from the faces 74 of the web 70 and extending longitudinally along stringer profiles 102 corresponding to further longitudinal profile components 64 of the overall outer contour configuration C of the striking portion 60. The stringers 100 join the ribs 80 of the first set 90 with the ribs 80 of the second set 92. In the preferred construction, the stringers 100 are unitary with the ribs 80 and extend along a plane 104 (see FIG. 12) extending in longitudinal and lateral directions normal to plane 78 and passing through axis A to bisect the web 70. A cap 110 at the first end 54 is unitary with the web 70 and completes the striking portion 60.

Figure 5:
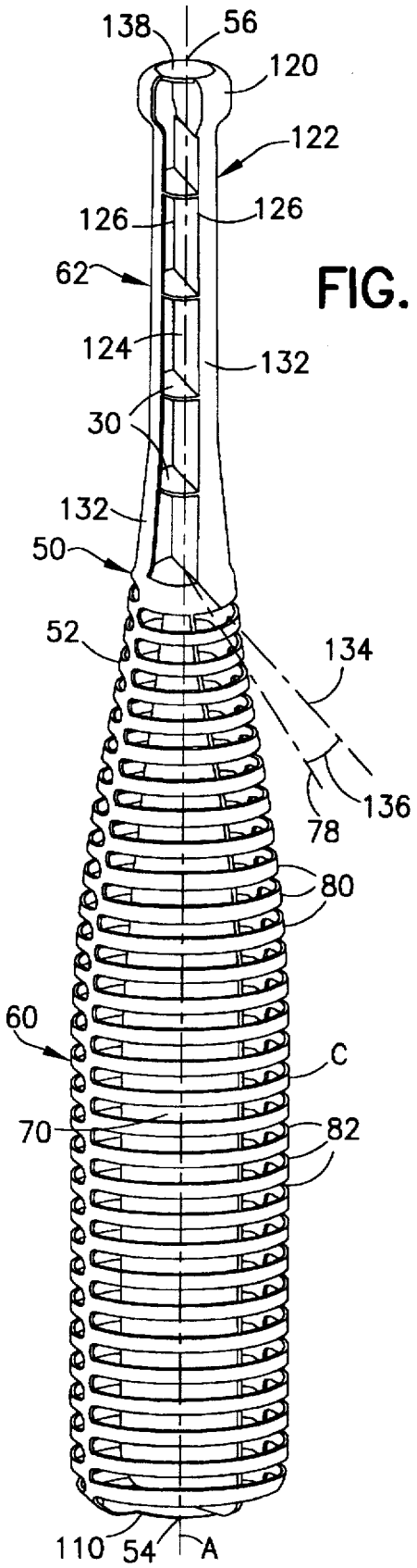
FIG. 5 is a pictorial perspective view of a toy baseball bat constructed in accordance with the present invention.
Figure 8:
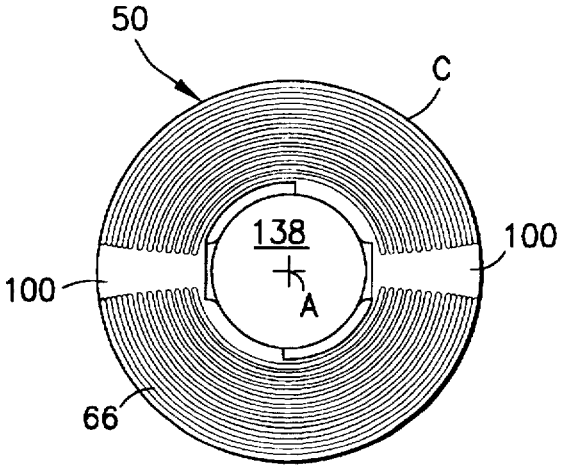
FIG. 8 is a top end view of the toy baseball bat.
Figure 9:
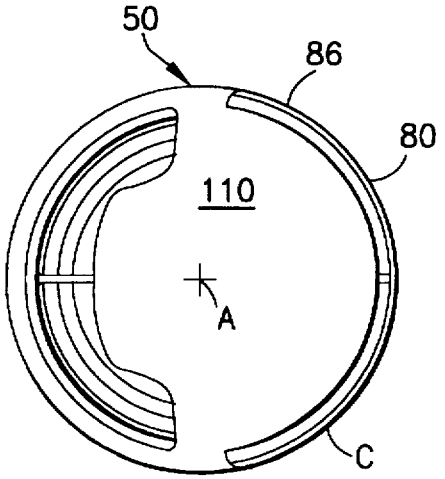
FIG. 9 is a bottom end view of the toy baseball bat.
Figure 6:
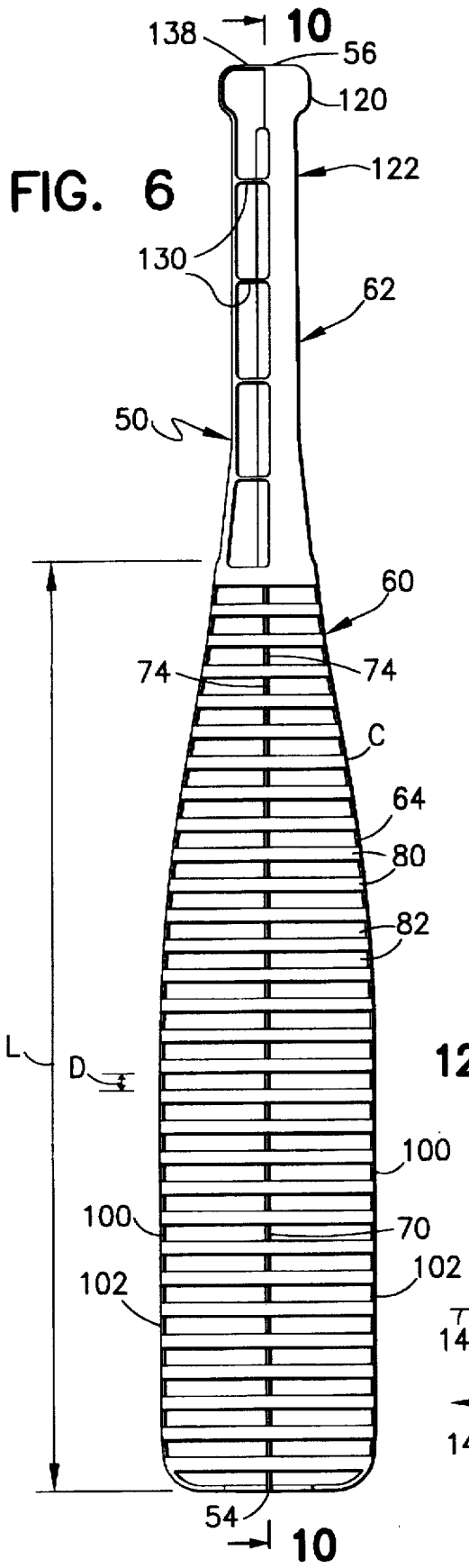
FIG. 6 is a front elevational view of the toy baseball bat.

The gripping portion 62 extends longitudinally between the second end 56 and the striking portion 60 and preferably is unitary with the striking portion 60. A collar 120 is placed at the second end 56 and a hand grip 122 extends longitudinally from the collar 120 to the striking portion 60, as in an actual baseball bat. The gripping portion 62 itself includes a plate 124 extending longitudinally along the gripping portion 62 and laterally between laterally opposite edges 126. Plate 124 preferably is in the form of a solid, essentially flat wall having essentially planar faces 128. Formers 130 extend from the faces 128 generally perpendicular to plate 124 and are spaced from one another longitudinally along the gripping portion 62. The formers 130 support hand grip elements 132 which extend longitudinally along the gripping portion 62 and are curved around the gripping portion 62 to establish the hand grip 122. In the preferred arrangement, the plate 124 is located in a plane 134 which extends in longitudinal and lateral directions and is located generally centrally within the gripping portion 62 and contains axis A; however, plate 124 is offset at a slight angle 136 from the plane 78 in which the web 70 lies, as seen in FIG. 5, so as to facilitate the molding of the gripping portion 62, and especially the hand grip 122 thereof, unitary with the striking portion 60 of the bat 50. Preferably, angle 136 is about 2°. An end wall 138 closes the second end 56 of the body 50.

Figure 7:
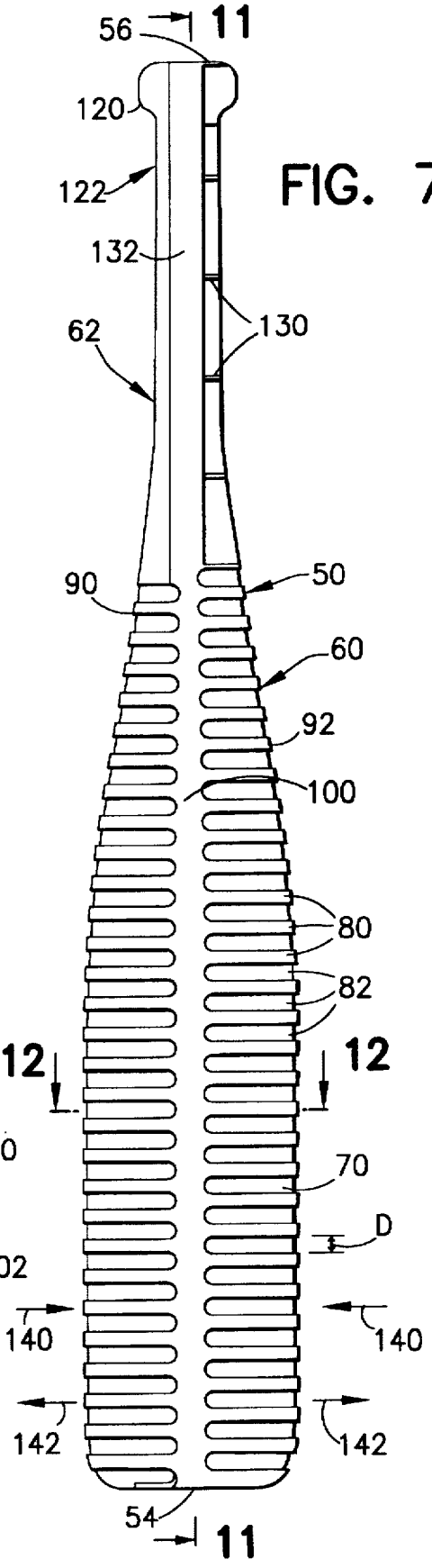
FIG. 7 is a side elevational view of the toy baseball bat.
Figure 10:
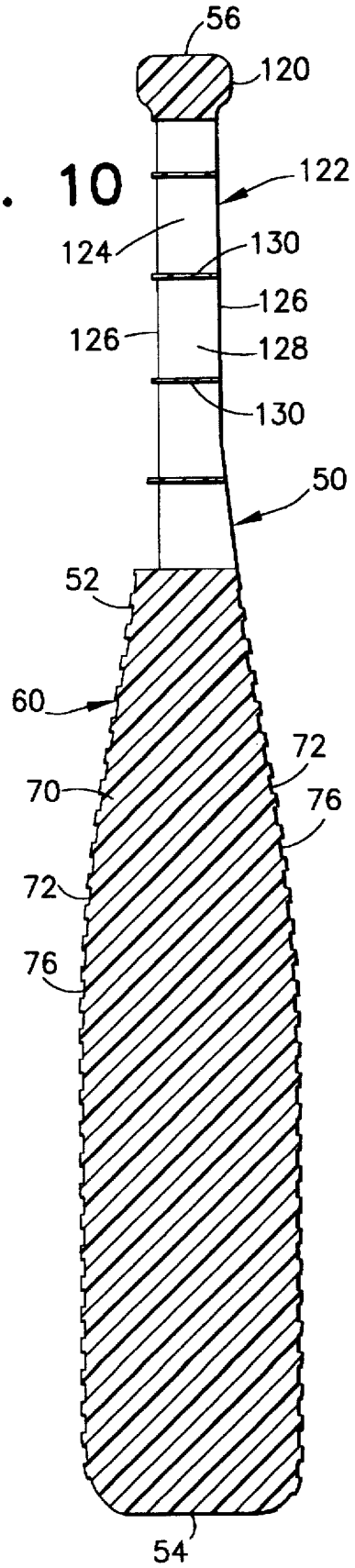
FIG. 10 is a cross-sectional view taken along line 10—10 of FIG. 6.
Figure 11:
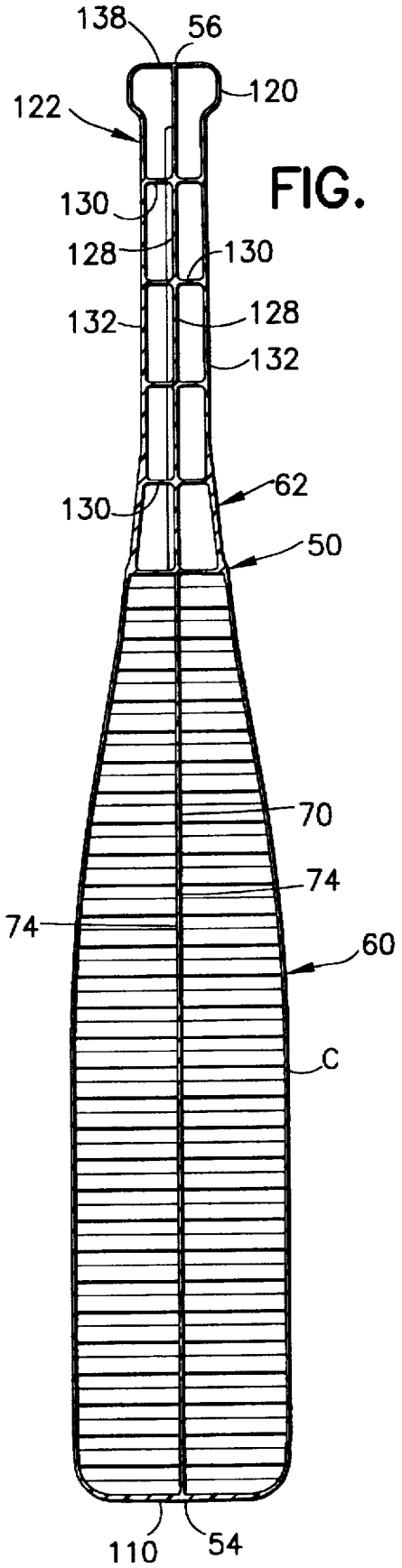
FIG. 11 is a cross-sectional view taken along line 11—11 of FIG. 7.
Figure 12:
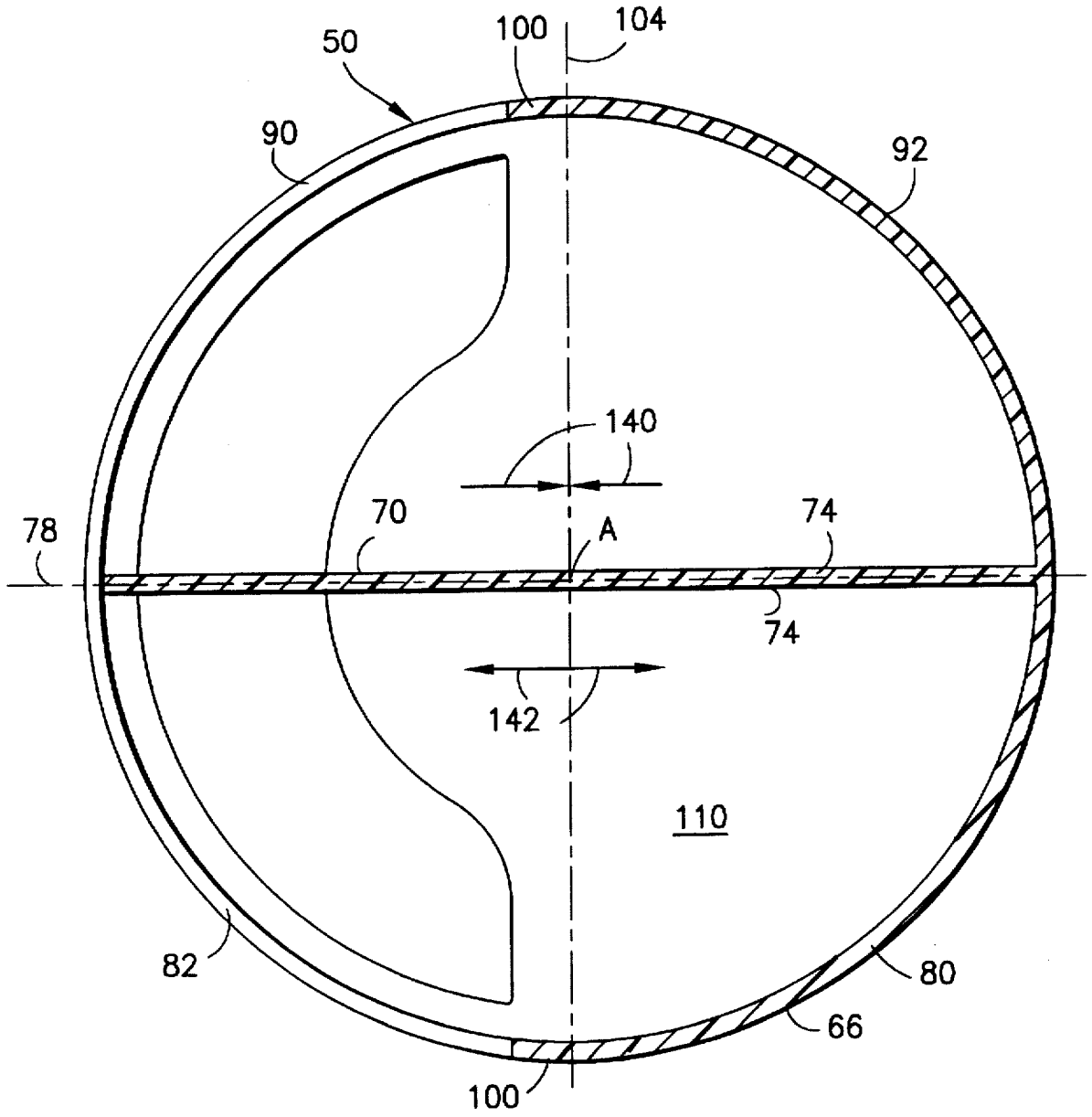
FIG. 12 is an enlarged cross-sectional view taken along line 12—12 of FIG. 7.

The above-described construction is especially well-suited to molding by injection molding, allowing the use of preferred synthetic polymeric materials, such as high-desity polyethylene. As best seen in FIGS. 7 and 12, the configuration of bat 50 allows injection molding dies (not shown) to be engaged and parted along directions 140 and 142, respectively, in the manufacture of bat 50. Thus, bat 50 preferably is molded in a single, unitary construction which includes all of the elements of the striking portion 60 and the gripping portion 62 joined together in a one-piece bat 50. The ribbed construction of the striking portion 60, with the reinforcement provided by the web 70 and the stringers 100, enables a desired resiliency for a toy bat with sufficient strength for rugged and reliable performance over a long service life. In addition, the ribbed construction offers a unique appearance which is both aesthetically appealing and highly distinctive. The reinforcement provided to the hand grip elements 132 by the plate 124 and the formers 130 establishes a desired high degree of rigidity as well as comfort in hand grip 122.

It will be seen that the construction of bat 50 attains the objects and advantages outlined above, namely: Enables the manufacture of toy striking implements, such as toy baseball bats, using injection molding techniques and materials heretofore not available for such toys; provides toy striking implements, such as bats, clubs, sticks and the like, of increased strength and reliability; produces toy striking implements which exhibit an effective combination of unique and highly distinctive form as well as an aesthetically attractive appearance; attains a desired resilience coupled with reinforced strength in toy striking implements of economical construction; allows economical manufacture of toy striking implements of better controlled dimensions in larger quantities of consistently higher quality and in a wider variety of desirable shapes, sizes and colors; enables the manufacture of rugged toy striking implements providing exemplary performance over a relatively long service life.

It is to be understood that the above-described detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A toy striking implement particularly well-suited for manufacture by injection molding of a synthetic polymeric material, the implement comprising:

an elongate body extending longitudinally between opposite first and second ends and including a striking portion and a gripping portion;

the striking portion of the body having:

a longitudinal length;

an outer contour configuration including longitudinal profile components and lateral profile components;

a web extending longitudinally between the first end and the second end, the web including laterally opposite edges and opposite faces extending between the laterally opposite edges, each edge following a web-edge profile corresponding to a longitudinal profile component of the outer contour configuration of the striking portion;

a plurality of ribs spaced from one another longitudinally along the striking portion to establish spaces between adjacent ribs, the ribs intersecting the web along the edges of the web, each rib being placed at an individual longitudinal location along the web and following a rib profile corresponding to a lateral profile component of the outer contour configuration of the striking portion, the ribs and spaces being grouped in laterally opposite first and second sets of ribs and spaces, the first set of ribs and spaces being staggered longitudinally with respect to the second set of ribs and spaces such that the ribs of the first set are located laterally opposite the spaces of the second set and the ribs of the second set are located laterally opposite the spaces of the first set; and stringers spaced laterally from the opposite faces of the web and joining the ribs of the first set to the ribs of the second set, the stringers extending along stringer profiles corresponding to further longitudinal profile components of the outer contour configuration of the striking portion; and the gripping portion of the body having a hand grip extending between the striking portion and the second end of the body.

2. The invention of claim 1 wherein the web is essentially solid between the laterally opposite edges of the web.

3. The invention of claim 1 wherein the web lies generally within a first plane extending in longitudinal and lateral directions.

4. The invention of claim 3 wherein the web is essentially solid between the laterally opposite edges of the web.

5. The invention of claim 3 wherein the stringers lie in a second plane extending essentially in longitudinal and lateral directions, essentially normal to the first plane.

6. The invention of claim 5 wherein the second plane essentially bisects the web.

7. The invention of claim 6 wherein the ribs are arcuate in further planes extending essentially normal to the first and second planes, each rib having a radius lying in a corresponding one of the further planes.

8. The invention of claim 7 wherein the space between the ribs is no more than 0.250 inch.

9. The invention of claim 7 wherein the space between the ribs is no less than 0.310 inch.

10. The invention of claim 7 wherein the space between the ribs is about 0.340 inch.

11. The invention of claim 7 wherein the striking implement is a toy baseball bat and the radii of the ribs are varied along the longitudinal length of the striking portion to establish a baseball bat configuration.

12. The invention of claim 11 wherein the striking portion and the gripping portion comprise a unitary structure molded of a synthetic polymeric material.

13. The invention of claim 1 wherein the space between the ribs is no more than 0.250 inch.

14. The invention of claim 1 wherein the space between the ribs is no less than 0.310 inch.

15. The invention of claim 1 wherein the space between the ribs is about 0.340 inch.

16. The invention of claim 1 wherein the striking portion and the gripping portion comprise a unitary structure molded of a synthetic polymeric material.

17. The invention of claim 1 wherein the gripping portion includes:

a plate extending longitudinally between the second end and the striking portion;

a plurality of formers projecting laterally from the plate; and hand grip elements supported by the formers and extending longitudinally along the gripping portion to establish the hand grip.

18. The invention of claim 17 wherein the hand grip elements are curved around the gripping portion.

19. The invention of claim 17 wherein the web lies generally within a first plane extending in longitudinal and lateral directions, and the plate is essentially flat and is located in a further plane extending in longitudinal and lateral directions and offset at a slight angle to the first plane.

20. The invention of claim 19 wherein the slight angle is about 2°.

* * * * *